US005422863A

United States Patent [19]

Minowa et al.

[11] Patent Number: 5,422,863

[45] Date of Patent: Jun. 6, 1995

[54] AUTOMATICALLY CORRECTING ELECTRONIC TIMEPIECE FOR SELECTED SIGNAL RECEIVING WIRELESS RECEIVER

[75] Inventors: Yoshiki Minowa; Yukio Yokozawa, both of Suwa, Japan

[73] Assignee: Seiko Epson Corporation, Tokyo, Japan

[21] Appl. No.: 218,871

[22] Filed: Mar. 28, 1994

Related U.S. Application Data

[63] Continuation of Ser. No. 609,679, Nov. 6, 1990, abandoned.

[30] Foreign Application Priority Data

Nov. 8, 1989 [JP] Japan ..... 1-290514
Sep. 12, 1990 [JP] Japan ..... 2-241997

[51] Int. Cl.[6] ..... G04C 11/02
[52] U.S. Cl. ..... 368/47; 368/55
[58] Field of Search ..... 368/45–55

[56] References Cited

U.S. PATENT DOCUMENTS 4,204,398 5/1980 Lemelson ..... 368/47
4,440,501 4/1984 Schulz ..... 368/47
4,525,685 6/1985 Hesslberth ..... 368/47
4,569,598 2/1986 Jacobs ..... 368/47
4,582,434 4/1986 Planngger et al. ..... 368/47
4,650,344 3/1987 Allgaier et al. ..... 368/47
4,823,328 4/1989 Conklin et al. .

FOREIGN PATENT DOCUMENTS 0305200 1/1989 European Pat. Off. .
2715096 12/1978 Germany .

*Primary Examiner*—Bernard Roskoski
*Attorney, Agent, or Firm*—Stroock & Stroock & Lavan

[57] ABSTRACT

An electronic timepiece which corrects time automatically in response to external time information signals. The timepiece includes a first timekeeping circuit for keeping a standard time and a receiver for selectively receiving external signals. A checking circuit checks the external signal to determine whether it contains a time information signal and which provides a current time signal in response to receipt of a time information signal. A second timekeeping circuit receives and stores the current time signal and a setting circuit sets the second timekeeping circuit to the current time in accordance with the current time signal. A correction circuit provides a correction signal and corrects the first timekeeping circuit to the current time in accordance with the correction signal and the current time signal. The correction is applied periodically at a rate which is a function of the error and the time between sucessive reciepts of the time information signal.

9 Claims, 2 Drawing Sheets

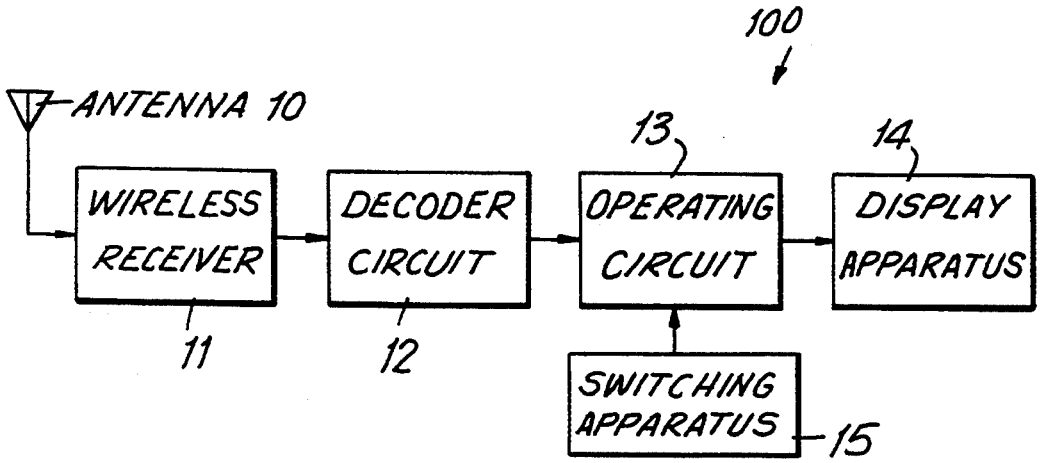
FIG. 1
FIG. 2
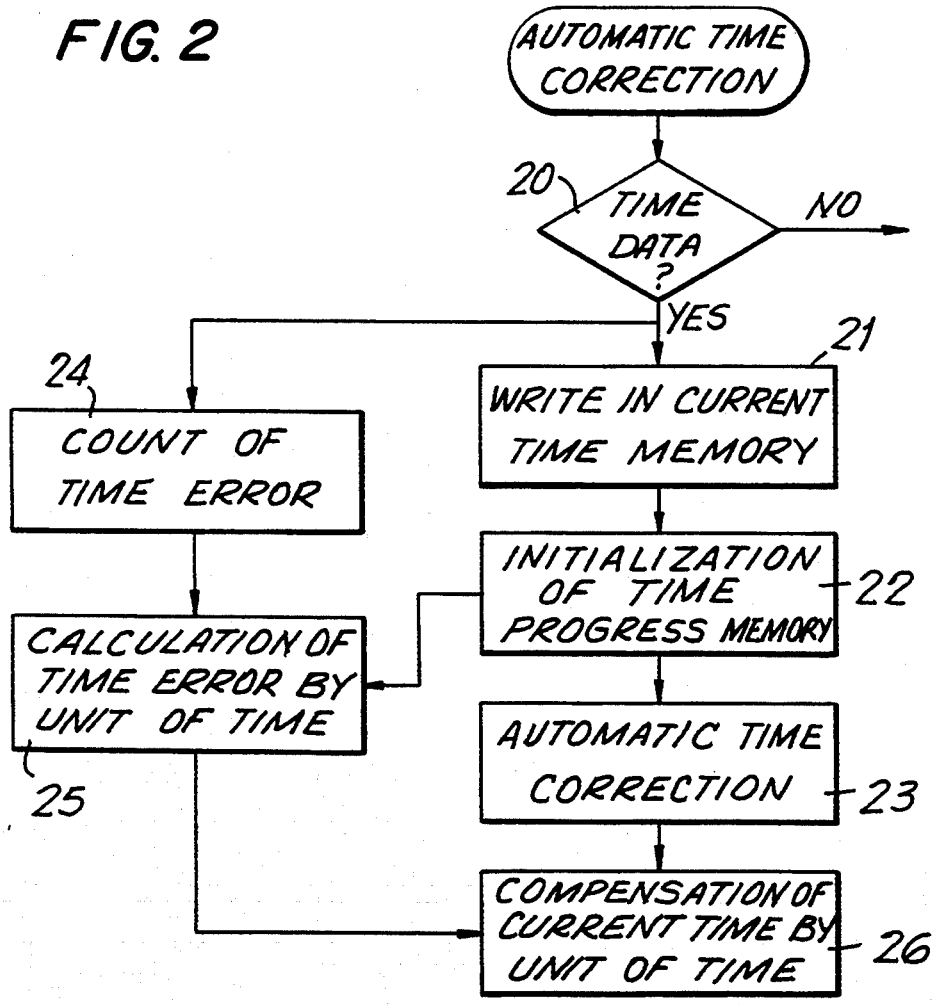

AUTOMATICALLY CORRECTING ELECTRONIC TIMEPIECE FOR SELECTED SIGNAL RECEIVING WIRELESS RECEIVER

This is a continuation of application Ser. No. 07/609,679 filed Nov. 6, 1990, now abandoned.

BACKGROUND OF THE INVENTION

This invention relates generally to the automatic correction of an electric timepiece using a wireless receiver and, in particular, to the automatic time correction of an electronic timepiece having a wireless receiver. The automatic time correction is performed in accordance with an external signal received by the wireless receiver.

Conventional electronic timepieces for use with wireless receivers are not generally provided with automatic time correcting functions that correct the time via an external signal. However, electronic timepieces in clocks in which time is automatically corrected every hour by receiving time information from the radio are known. Such electronic timepieces for clocks that receive time information from the radio are very limited in function. The electronic timepieces for clocks cannot be used with a wireless receiver. Further, the time information received from the radio is limited to time units of minutes and seconds. Accordingly, such clocks are unable to correct by the time unit of hours or the date.

Additionally, since the time unit is corrected in hourly intervals kept by its own standard time, the accumulated time error is corrected at one correction time when the information is received from the radio. Thus, this time correction technology is not capable of maintaining the correct time throughout the hour. It is only capable of keeping the correct time at one point during the hour. Furthermore, such time correcting technology would be especially inadequate for a stopwatch. An automatically corrected electronic timepiece with a selected signal receiving wireless receiver which is capable of constantly updating the time, thereby maintaining perfectly correct time information, has not yet been manufactured. The present invention provides such a system.

Recently, a multiplex broadcast system has been provided in which the bus standard for home automation is being unified. Thus, systems for providing external time information have been improved. However, the disadvantage that time error is accumulated from one time correction to the next has not been improved. Hence, even if accurate external time information is being provided to the electronic timepiece, the timepiece will not provide highly accurate time unless the electronic timepiece is capable of automatically adjusting at high accuracy. Thus, the prior art suffers not from a problem in receiving external time information in a punctual manner, but suffers from the inability to automatically correct or adjust the electronic timepiece in a punctual manner so as to keep the time displayed constantly correct at all points during the hour.

Accordingly, it is desired to provide an automatically corrected electronic timepiece for a wireless receiver in which time correction is accurately achieved.

SUMMARY OF THE INVENTION

Generally speaking, in accordance with the present invention, an electronic timepiece which corrects time automatically in response to external time information signals, is provided. The timepiece includes a first timekeeping circuit for keeping a standard time and a receiver for selectively receiving external signals. A checking circuit checks each received external signal to determine whether the external signal contains a time information signal and provides a current time signal representative of current time in response to receipt of a time information signal. A second timekeeping circuit receives and stores the current time signal. A setting circuit sets the second timekeeping circuit to the current time in accordance with the current time signal. A correction circuit provides a correction signal and corrects the first timekeeping circuit to the current time in accordance with the correction signal and the current time signal.

In a preferred embodiment, the correction circuit includes a first counter circuit for counting the time gap between the current time and the standard time and a second counter circuit for counting the time interval between time corrections of the first timekeeping circuit. A division circuit divides the time gap counted in the first counter circuit by the time interval counted in the second counting circuit to produce a correction factor. A compensating circuit compensates the first timekeeping circuit at a predetermined time interval in accordance with the correction factor.

Accordingly, it is an object of the present invention to provide an improved timepiece capable of automatically correcting the displayed time based on external signals received by a wireless receiver.

Another object of the present invention is to provide an improved automatically correcting electronic timepiece with wireless receiver that is capable of updating and correcting the standard time thereby requiring only slight changes in the displayed time.

A further object of the present invention is to provide an improved automatically correcting electronic timepiece with wireless receiver that is checked frequently and is so accurate that it may be used in a stopwatch.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a block circuit diagram showing the structure of an electronic timepiece with an external time information receiving function constructed according to a first embodiment of the present invention;

FIG. 2 is a flow chart for use in explaining the time information receiving process of the present invention;

DETAILED DESCRIPTION OF THE PREFERRED EMBODIMENTS

Figure 3:
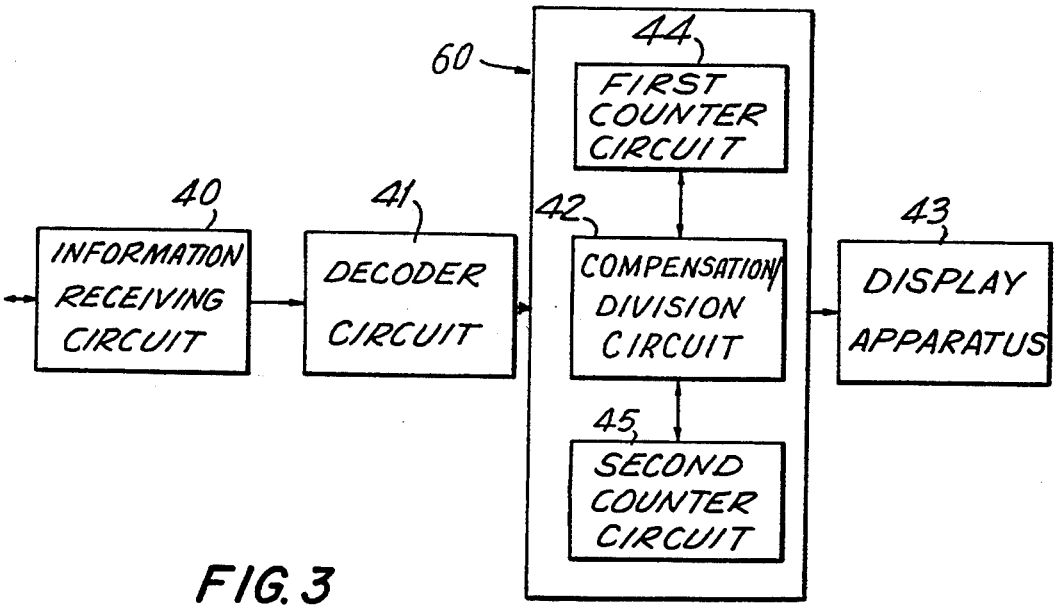
FIG. 3 is a block circuit diagram showing the structure of an electronic timepiece according to another embodiment of the present invention.

Reference is first made to FIG. 1, which depicts an electronic timepiece, generally indicated at 100, constructed in accordance with a first embodiment of the present invention. An antenna 10 is adapted to receive an external signal. The external signal received by antenna 10 is converted into a digital signal by wireless receiver 11. The digital signal is then checked by decoder circuit 12. If decoder circuit 12 determines that the external signal contains a time information signal, then the external signal is transmitted to operating circuit 13. Switching apparatus 15 and display apparatus 14 are coupled to operating circuit 13.

Reference is now made additionally to FIG. 2, wherein the time information receiving process is depicted. The time information transmitted from decoder 12 (FIG. 1) is checked again in time information judgment at step 20. This second check is to insure that improper information does not produce incorrect timekeeping results. Thus, decoder circuit 12 first determines whether the received signal is time information, then operating circuit 13 checks again to determine whether the information actually exists as time data therein.

For example, if a signal "15" is received as representing month data, operating circuit 13 judges this signal to be wrong even if it has already been checked and corrected in decoder circuit 12. Accordingly, information adjudged incorrect is not used.

Time information judged to be correct is written into time information recording portion at step 21. This results in the current time being automatically corrected in the time keeping circuit of the electronic timepiece with external signal receiving function at step 23. Coinciding with this event, the time error between the time information received and the current time kept by the timepiece at that instant is counted in step 24. The recording portion 22 of operating circuit 13 is initialized and counts the time interval of each time correction and then begins to count the time until the next time information is received. At the same time, the time error counted is divided by the result of the last count in operating circuit 13 at step 25. The result of this division is added to the current time when the electronic timepiece is fast, and is subtracted from the current time when it is slow. This addition or subtraction occurs at the next time keeping occasion of the standard time at certain predetermined time intervals in step 26.

The accuracy of the automatic time correction is affected by the accuracy of the external time information. Furthermore the accuracy of the automatic time correction is also affected by the electronic timepiece itself because the time correcting process in the electronic timepiece requires a certain time to be performed. After the time correction, the accuracy of the standard time becomes the same as that of the corrected time.

When a crystal of 32,768 Hz is used, as is generally the case in electronic timepieces, an error is produced at the rate of 20 seconds per month at normal temperature. For example, if the automatic time correction takes place every hour, a maximum error of 0.03 seconds per hour is produced. The error can be reduced by providing shorter time intervals of automatic time correction, but this consumes more electrical current. Additionally, if the electronic wave form is in poor condition, the error is accumulated and then the time may be corrected at the second time unit level at the next automatic time correcting occasion.

As the time keeping function becomes discontinuous in this manner, such electronic timepieces are not desirable for an apparatus for measurement or for a stop watch even if they have an automatic function receiving the correct time information and correcting the current time. Furthermore, without external time information, the accuracy of such conventional electronic timepieces is the same as an ordinary timepiece.

According to the present invention, however, the time error between the time information receiving intervals is divided by a certain time unit and is fed back until the next time keeping occasion. For example, when the time in the electronic timepiece becomes 0.1 seconds fast during a five hour period of time in which the time was not updated, the current time is decreased by 0.01 seconds every 30 minutes from the next time keeping occasion. Therefore, it is possible to keep the time much more accurate then that of the standard time. Moreover, even if the standard time is affected by aging of the clock components or by temperature fluctuations during the year, it is nonetheless possible to automatically correct the time in such an electronic timepiece. This provides a timepiece which is highly accurate without punctual time corrections. Furthermore, such construction avoids the problems that occur when a bad signal is received and automatically corrected at that instant.

Reference is now made to FIG. 3, wherein information receiving circuit 40 is depicted receiving external time information and transmitting the time information to predetermined addresses in an information BUS. An operating circuit, generally indicated at 60, includes a first counter-circuit 44, a second counter-circuit 45 and a compensation/division circuit 42. First counter-circuit 44 counts the corrected time that was corrected in the automatic time correction. The second counter-circuit 45 counts the time interval of the automatic time correction. Information receiving circuit 40 receives the signal and converts it into a digital signal. The digital signal is then transmitted to decoder circuit 41 where it is corrected.

Decoder circuit 41 then receives the predetermined designation signal from information receiving circuit 40, and transmits the time information to the operating circuit 60. Operating circuit 42 then writes the time information into the current time memory portion of the time keeping circuit, thereby, automatically correcting the time. Simultaneously with this event, first counter circuit 44 counts the written corrected time, and second counter-circuit 45 counts the time interval between the last time correction and this time correction in every predetermined time unit, for example, every ten minutes. The corrected time counted in first counter-circuit 44 is divided by the time interval counted in second counter-circuit 45 by compensation/division circuit 42 of operating circuit 60 and the time is adjusted every time unit of second counter-circuit 45 by compensation/division circuit 42. The adjustment is made in accordance with the results of the calculation after the automatic time correction. Furthermore, even if the time cannot be adjusted in accordance with the calculation because of a lack of correspondence between the result of the calculation and the clock frequency, it is possible in the present electronic timepiece function to adjust the time by selecting an approximate adjustment amount of time or by adding or limiting the frequency of adjustments. The error may be counted following the automatic time correction. The time is adjusted in the same manner as stated above provided the error is within a predetermined range, and if the error is outside that predetermined range, then the previous time adjustment value is calculated again.

Figure 4:
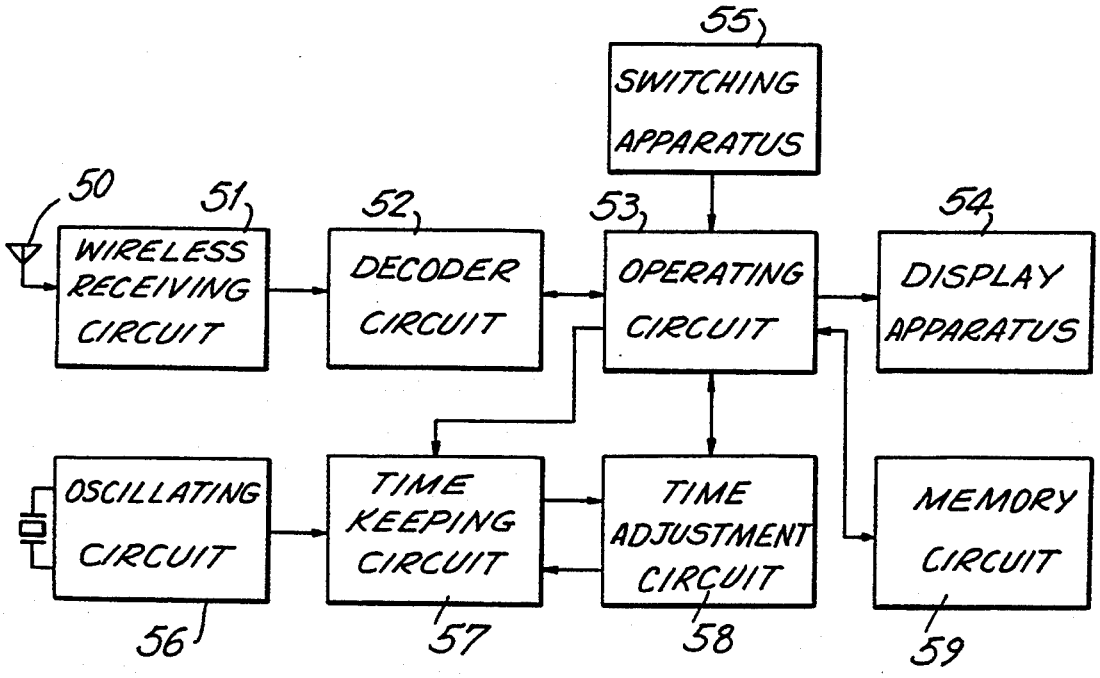
FIG. 4 is a block circuit diagram showing the structure of an electronic timepiece with external time information receiving function according to another embodiment of the present invention.

Reference is now made to FIG. 4, wherein antenna 50, wireless receiving circuit 51 and decoder 52 receive external time information in the same manner as FIG. 1. Operating circuit 53 reads the information of the last time adjustment stored in memory circuit 59 and counts the time elapsed from the last time adjustment. Operating circuit 53 simultaneously calculates the time to be adjusted presently by judging the difference between the time stored in time keeping circuit 57 and the time received from the external time information. The time to be adjusted per unit "A" is calculated by dividing the adjusted time by the elapsed time. The result of this calculation is stored in memory circuit 59.

Oscillating circuit 56 transmits a 256 Hz signal to time keeping circuit 57. Time keeping circuit 57 stores the 256 Hz signal and the dividing circuit of time keeping circuit 57 divides the 256 Hz signal into equal portions of 1 Hz. If no time compensation or adjustment signal is received from operating circuit 53, than the dividing circuit counts 256 Hz 256 times and outputs 1 Hz. Alternatively, when a time compensation or adjustment signal is received the count may be reset. Therefore, it is possible for the time to be adjusted every 1/256 seconds when the time to be adjusted or compensated per unit "A" is calculated. For example, if operating circuit 53 sets 256 adjustments per time unit in time compensating circuit 58, then every 1/256 seconds an adjustment will be completed.

The present invention is not limited to the embodiments described above. It is also applicable for use in any communication apparatus having time keeping functions, such as, apparatus for measurement, stop watches, or timers of high resolution.

Furthermore, as displayed through the above embodiments, it is possible to reduce to a minimum the difference between the standard time kept in the time keeping circuit and the external time information received, thereby keeping the correct time continuously.

It will thus be seen that the objects set forth above among those made apparent from the preceding description, are efficiently attained and since certain changes may be made in the above constructions without departing from the spirit and scope of the invention, it is intended that all matter contained in the above description and shown in the accompanying drawing(s) shall be interpreted as illustrative and not in a limiting sense.

It is also to be understood that the following claims are intended to cover all of the generic and specific features of the invention herein described and all statements of the scope of the invention which as a matter of language, might be said to fall therebetween.

What is claimed is:

1. An electronic timepiece which corrects time automatically in response to external time information signals comprising display means for displaying the time, timekeeping means for keeping a standard time and for changing the time displayed on said display means in accordance therewith, receiver means for selectively receiving external signals and for checking each said received external signal to determine whether said external signal contains a time information signal and providing a current time signal representative of current time in response to receipt of a time information signal, said display means being adjusted to display said current time in response to receipt of said current time signal, first means for determining a magnitude of a time gap between said standard time and said current time, second means for counting an elapsed time between successive receipt of said time information signals and compensating means for periodically compensating said timekeeping means at predetermined time intervals between receipt of said external time information signals by a factor determined from the ratio of said time gap divided by said elapsed time between receipt of said external time information signals, said predetermined intervals each being less than the elapsed time between successive receipt of said external time information signals.

2. The electronic timepiece as claimed in claim 1, further comprising division means for dividing said magnitude of said time gap counted in said first means by the elapsed time in said second means.

3. The electronic timepiece as claimed in claim 2, wherein said compensating means compensates the time kept by said timekeeping means by adding at least a portion of the magnitude of the time gap in said first means to the standard time of said timekeeping means at said predetermined time interval.

4. The electronic timepiece as claimed in claim 2, wherein said compensating means compensates the time kept by said timekeeping means by subtracting at least a portion of the magnitude of said time gap in said first means from the standard time of said timekeeping means at said predetermined time interval.

5. The electronic timepiece as claimed in claim 2, wherein said compensating means compensates the time kept by said timekeeping means by adding to the time kept by said timekeeping means at said predetermined time intervals between receipt of said external time information signals.

6. The electronic timepiece as claimed in claim 2, wherein said compensating means compensates the time kept by said timekeeping means by subtracting from the time kept by said timekeeping means at said predetermined time intervals between receipt of said external time information signals.

7. A timepiece for correcting time in response to external time information signals comprising receiver means for receiving said external time information signals and for providing a current time in response thereto, timekeeping means including an oscillating circuit for providing a standard time, detection means for detecting a magnitude of a time gap between said current time and said standard time, means for counting an elapsed time between receipt of successive external time information signals, division means for dividing said magnitude of said time gap detected by said detection means by the elapsed time counted by said means for counting to produce a compensation factor, and compensation means for periodically compensating the time kept by said timekeeping means at predetermined intervals between receipt of said external time information signals, said periodic compensation being a function of said compensation factor, said predetermined intervals each being less than the elapsed time between successive receipt of external time information signals.

8. A method of keeping and correcting time in a timepiece having a standard timekeeping means using external time information signals from a current timekeeping means, comprising the steps of:

receiving an external first time information signal from a current timekeeping means at a first time $t_1$;

setting a standard timekeeping means to said first time $t_1$;

receiving a second time information signal representing the current time from said current timekeeping means at a second time $t_2$;

calculating an elapsed time $\Delta t$ between said first time signal $t_1$ and said second time signal $t_2$ ($\Delta t = t_2 - t_1$);

calculating a time error $t'$ between said current time $t_2$ and said standard time $t_2'$ when said second time signal is received ($t' = t_2 - t_2'$);

calculating a compensation factor A by dividing the time error $t'$ by the elapsed time $\Delta t$ ($A = t'/\Delta t$); and compensating said standard timekeeping means by said compensation factor A by periodically adjusting said time kept by said standard timekeeping means at predetermined intervals between receipt of said external time information signals, said predetermined intervals being less than the elapsed time $\Delta t$ between said first time signal $t_1$ and said second time signal $t_2$.

9. A timepiece having a standard timekeeping means which corrects time in response to receipt of external signals from a current timekeeping means, comprising:

receiving means for receiving a first time information signal from said current timekeeping means at a first time $t_1$;

setting means for setting said standard timekeeping means to said first time $t_1$, said standard timekeeping means including clock means for keeping time;

said receiving means for receiving a second time information signal from said current timekeeping means at a second time $t_2$ representing the current time;

means for calculating an elapsed time $\Delta t$ between said first time $t_1$ and said second time $t_2$ ($\Delta t = t_2 - t_1$);

means for calculating the time error $t'$ between said current time $t_2$ and said standard time $t_2'$ at said second time ($t' = t_2 - t_2'$);

means for dividing the time error by the elapsed time to produce a compensation factor A ($A = t'/\Delta t$); and correction means to correct said standard time by said compensation factor A by periodically adjusting said standard time at predetermined intervals between receipt of said time information signals said predetermined interval being a function of said compensation factor A, said predetermined intervals being less than the elapsed time $\Delta t$ between said first time $t_1$ and said second time $t_2$.

* * * * *